US006301912B1

(12) United States Patent
Terai et al.

(10) Patent No.: US 6,301,912 B1
(45) Date of Patent: Oct. 16, 2001

(54) HEAT PUMP APPARATUS

(75) Inventors: Toshiyuki Terai, Tochigi-ken; Isamu Tsubono, Ibaraki-ken; Koichi Sekiguchi, Tochigi-ken, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/397,852

(22) Filed: Sep. 17, 1999

(30) Foreign Application Priority Data

Sep. 1, 1998 (JP) ..... 10-264296

(51) Int. Cl.[7] ..... F25B 1/04
(52) U.S. Cl. ..... 62/228.4; 418/55.5
(58) Field of Search ..... 418/55.5; 62/228.4

(56) References Cited

U.S. PATENT DOCUMENTS 4,669,962 * 6/1987 Mizuno et al. ..... 418/55.5
6,086,335 * 7/2000 Bass et al. ..... 418/55.5

FOREIGN PATENT DOCUMENTS 60-249686 * 12/1985 (JP) ..... 418/55.5
1-163485 * 6/1989 (JP) ..... 418/55.5
1-253581 * 10/1989 (JP) ..... 418/55.5
2-218880 * 8/1990 (JP) ..... 418/55.5
3-65686 * 3/1991 (JP) ..... 418/55.5
4-219485 * 8/1992 (JP) ..... 418/55.5
5-1677 * 1/1993 (JP) ..... 418/55.5

* cited by examiner

*Primary Examiner*—William E. Tapolcai
(74) *Attorney, Agent, or Firm*—Antonelli, Terry, Stout & Kraus, LLP

(57) ABSTRACT

A heat pump apparatus comprising: a scroll compressor including an orbiting scroll member in which a spiral wrap is formed on a first base plate, and an non-orbiting scroll member in which a spiral wrap is formed on a second base plate and a back pressure chamber for introducing pressure into a side of the orbiting scroll member or the non-orbiting scroll member opposite to a compression chamber formed by the orbiting and non-orbiting scroll members; a heat-exchanger; an expansion device; device for detecting a consumption power of the heat pump apparatus or the compressor; and device for changing the pressure in the back pressure chamber in accordance with an output from the detecting device.

12 Claims, 15 Drawing Sheets

HEAT PUMP APPARATUS

BACKGROUND OF THE INVENTION

1. Filed of the Invention

The present invention relates to an air-conditioner, a refrigeration unit or the like driven by a heat-pump apparatus using a scroll-compressor.

2. Description of the Related Art

A conventional heat-pump apparatus will be described with reference to FIG. 2. A compressor 100, an evaporator 210, a condenser 220, and an expansion valve 230 are connected so as to constitute a circuitry as shown in FIG. 2. A control apparatus 240 is one for controlling the rotational speed of the compressor 100, which is formed of a power conversion equipment such as an inverter. For example, in an air-conditioner as an example of a heat-pump, the control device 240 adjusts the rotational speed of the compressor 100 within an controllable range through variable control or on-off control for the operation of the compressor 100 so as to adjust the indoor temperature to a set temperature which is a control target. Further, the control device 240 carries out also adjustment to the opening degree of the expansion valve 230, and adjustment to a draft rate of air fed into the evaporator 210 or the condenser 220. Thus, the heat-pump apparatus is operated through the control of refrigerating cycle so as to gain a required refrigerating capacity, and then is operated under such control that control values are decreased so as to restrain the power consumption after the indoor temperature reaches the set temperature.

The compressor used in this heat-pump is a scroll compressor of such a type that an orbiting scroll member having a spiral wrap formed on a base plate and an non-orbiting (stationary scroll) member having a spiral wrap formed on a base plate are meshed with each other so as to define a compression chamber. In this scroll compressor, a force to separate the orbiting scroll member and non-orbiting scroll is generated by pressure within the compression chamber. Accordingly, it is required to generate a force in a direction in which both scroll members are pressed to each other, against the above-mentioned separating force.

Specifically, a backside pressure zone is formed in a side of the base plate (an end plate in other words), opposite to the compression chamber, of at least one of the orbiting and non-orbiting scrolls, and fluid pressure is introduced into the backside pressure zone in order to generate a force (pressing force) to make the orbiting and non-orbiting scrolls close to one another. In this arrangement, the backside pressure is generated by a mechanism which is designed so as to set the backside pressure to an intermediate pressure between a suction pressure and a discharge pressure, which is equal to a value obtained by a formula, (a pressure in a certain part in the heat pump apparatus, such as the suction pressure)×(a substantially constant value)+(a substantially constant value).

As documents disclosing this type of arrangement to introduce pressure into the back pressure chamber, JP-A-7-217557 (document 1) and JP-A-64-381 (document 2) are known.

The document 1 discloses such an arrangement that the back pressure chamber and the suction side are communicated with each other thorough a pipe incorporating a pressure regulating valve and when a differential pressure becomes higher than a spring force set by a pressure regulating knob for initial setting, the valve is opened to set a differential pressure which corresponds to the spring force.

Further, the document 2 discloses such an arrangement that the back surface zone of the orbiting scroll is divided into two concentric pressure zones, high pressure being introduced into the inner zone and lower or high pressure being introduced into the outer zone in dependence upon a condition so as to change the pressing force.

In the above-mentioned document 1, the back pressure chamber induces therein a pressure corresponding to a suction pressure, so as to obtain a pressure corresponding to the once set spring force, that is, the pressure of the back pressure chamber becomes a value which is obtained by adding a pressure overcoming the spring force to the suction pressure. However, the relationship between the suction pressure and the pressure in the back pressure chamber is constant, and this document 1 fails to disclose such an arrangement that the pressure is set to a further appropriate pressure.

Further, in the above-mentioned documents 2, the pressure in the outer zone in the back pressure chamber is changed over through two stages in accordance with a high or low differential pressure, and although what is the high pressure or the low pressure is unclear, only two kinds of averaged pressures are used in the back pressure chamber. However, similar to the document 1, this document 2 also fails to disclose such an arrangement that the pressure is set to a further appropriate pressure.

SUMMARY OF THE INVENTION

An object of the present invention is to provide a heat-pump apparatus in which the pressure in the back pressure chamber can be set to an appropriate value.

To the end, according to the present invention, there is provided a heat pump apparatus comprising: a scroll compressor including an orbiting scroll member in which a spiral wrap is formed on a base plate, a non-orbiting scroll member in which a spiral wrap is formed on a base plate, and a back pressure chamber formed in a side of the orbiting or non-orbiting scroll member opposite to the compression chamber side; a heat-exchanger; an expansion means; means for detecting a power consumption in the heat pump apparatus or the scroll compressor; and means for changing the pressure in the back pressure chamber in accordance with an output from the detecting means.

DESCRIPTION OF THE PREFERRED EMBODIMENTS

Embodiments of the present invention, in the form of an air-conditioner as an example, will be described hereinafter with reference to the accompanying drawings.

Figure 1:
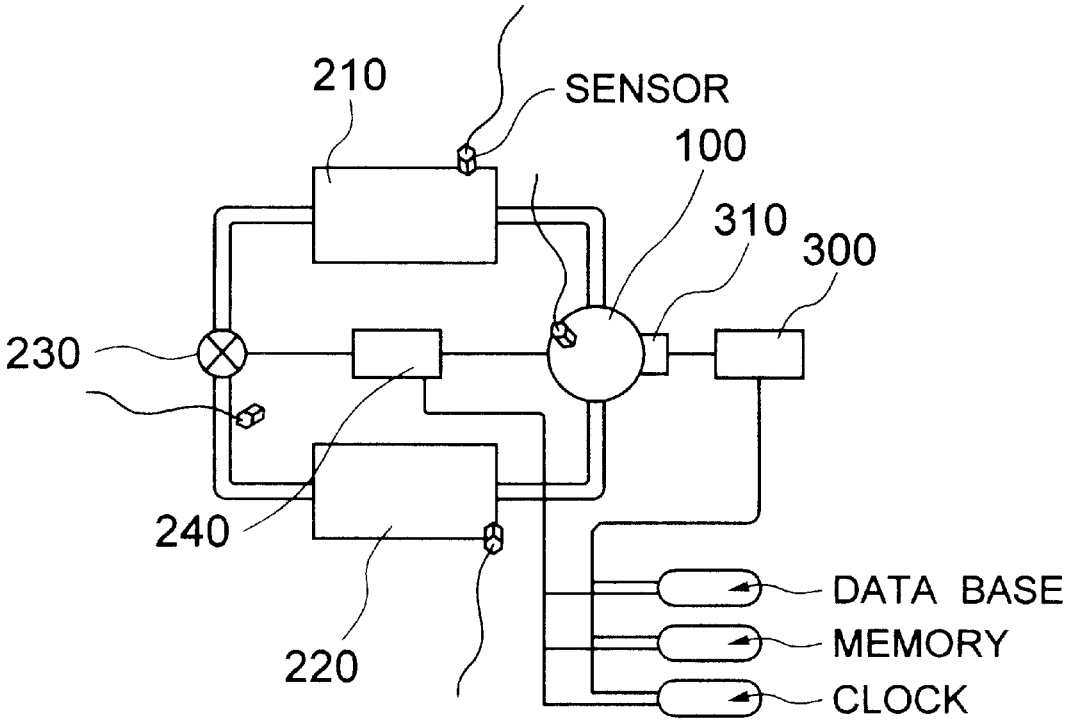
FIG. 1 is a view illustrating an arrangement of a heat-pump apparatus according to the present invention.
Figure 2:
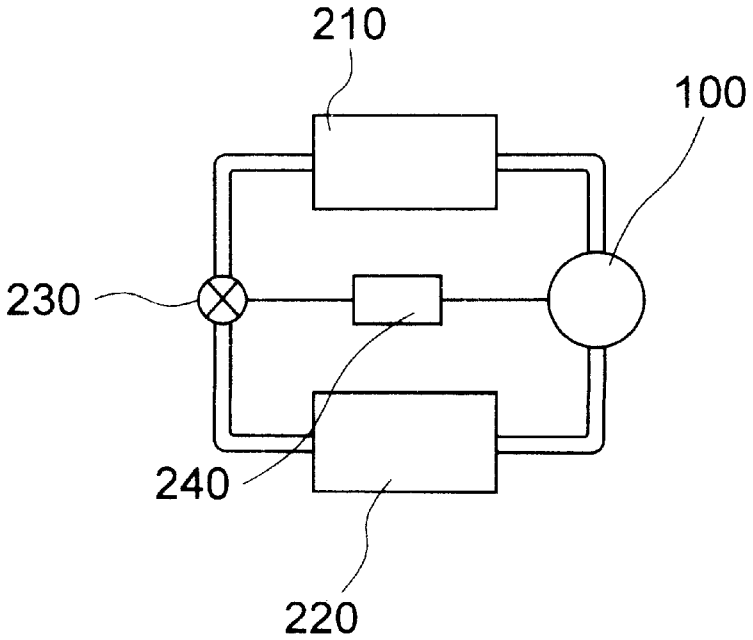
FIG. 2 PRIOR ART
FIG. 2 is a view illustrating an arrangement of a prior art heat-pump apparatus.

Referring to FIG. 1, a scroll compressor 100, an evaporator 210, a condenser 220, an expansion valve 230, a control device 240, a backside pressure regulator 310 and a control device 300 for the backside pressure regulator are connected so as to form a cycle. Refrigerant having a high temperature and a high pressure discharged from the compressor 100 is led into the condenser 220 and is condensed to radiate heat therefrom. Then, it is led into the expansion valve 230 and is reduced in pressure. Thereafter, the refrigerant is evaporated in the evaporator 210 to absorb heat. That is, a heat pump apparatus which carries out heat-transmission through refrigerating cycle is constituted. In this arrangement, if an indoor equipment of this air-conditioner is used as the evaporator, cooling operation is carried out while if it is used as a condenser, heating operation is carried out.

Figure 6:
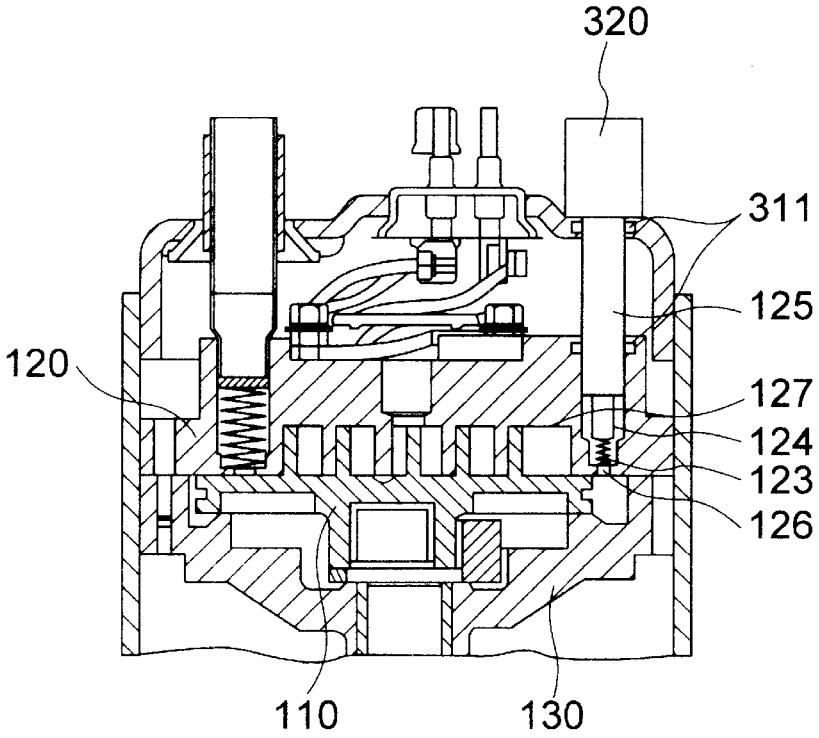
FIG. 6 is a view illustrating a 1st embodiment of a backside pressure control arrangement.

The compressor used in this air-conditioner is the scroll compressor 100. Referring to FIG. 6, a compressor part and a motor part (not shown) for driving the compressor part are accommodated in a sealed container, and the compressor part comprises an orbiting scroll member 110 in which a spiral wrap is formed on a base plate (end plate), and an non-orbiting (stationary) scroll member 120 in which a spiral wrap is formed on another base plate. The orbiting scroll member 110 of the compressor part is driven by a shaft which is rotated by the motor part, and which is rotatably supported by a frame 130 serving as a main bearing, and further, this frame 130 bears a thrust force from the orbiting scroll member 110. Gas refrigerant having a high temperature and a high pressure and discharged from a discharge port which is located at a substantially center part of the non-orbiting scroll member 120, is filled in the sealed container so that a discharge pressure is effected in this sealed container. Further, the refrigerant is delivered into the refrigerating cycle through a discharge pipe (not shown).

Further, refrigerator oil is reserved in the bottom part of the sealed container, and an end part of the shaft, on the side opposite to the compressor part, is immersed into the refrigerator oil. The refrigerator oil driven out by the discharge pressure flows through an oil feed passage formed in the shaft to lubricate the main bearing and the like. At the same time, the oil is fed also in a space (backside pressure chamber) defined between the orbiting scroll member 110 and the frame 130. Since the oil supply into the backside pressure chamber thereof is effected through a gap in the bearing, the pressure thereof is reduced to a value lower than the discharge pressure. A fluid pressure acting upon the base plate of the orbiting scroll member 110 on the side opposite to the compression chamber, is changed in response to a control signal by the back pressure regulator 310. The inventors have had such a conception that the power consumption of the compressor can be reduced by regulating the fluid pressure in the back pressure chamber.

Figure 3:
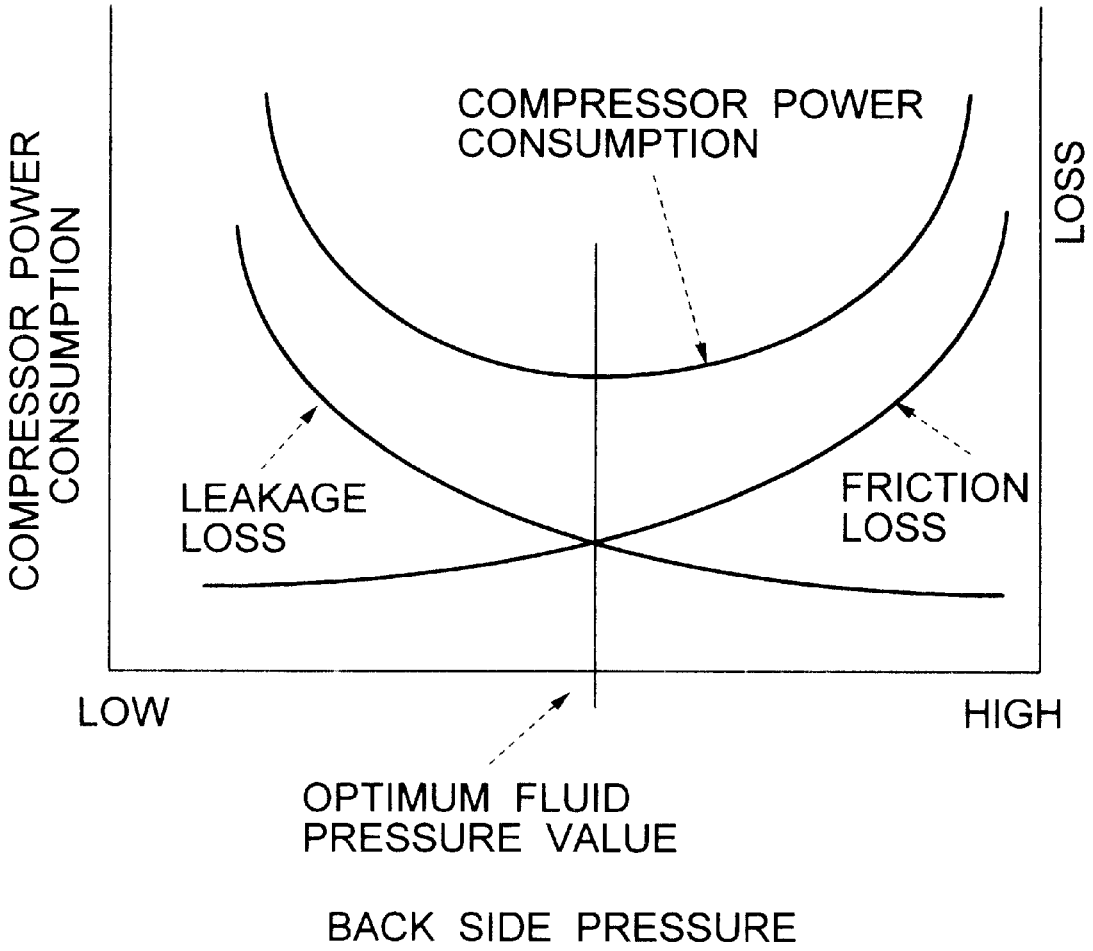
FIG. 3 is a graph showing a relationship between a back pressure and compressor power consumption.

Relationship between the value of backside pressure and the power consumption of the compressor will be described with reference to FIG. 3. In FIG. 3, the value of backside pressure (pressure in the backside pressure chamber) is taken along the abscissa, and the frictional loss, leakage loss and the power consumption of the compressor are taken along the ordinate.

When the backside pressure is changed, the force with which the orbiting scroll member is pressed against the non-orbiting scroll member is changed, and accordingly, the leakage loss in the compression chamber, and the frictional loss in a slide part are changed to greatly affect upon the power consumption.

At first, as to the leakage loss, when the force with which the orbiting scroll member is pressed against the non-orbiting scroll member is increased, the orbiting scroll member and the non-orbiting scroll member are deformed, and accordingly, the gap between contact parts of both members is decreased. Meanwhile, when this pressing force is decreased, this gap is increased. The scroll compressor has a structure such that compression is gradually effected from the circumference toward the center of the scroll members when the orbiting scroll member and the non-orbiting scroll member in combination are subjected to orbiting motion, and a plurality of crescent-like compression chambers are defined therein. Accordingly, a differential pressure is induced between adjacent compression chambers, and refrigerant as working medium leaks toward the outer compression chamber having a lower pressure through a gap between the base plate of one of the scroll members and an end of the wrap of the other of the scroll members, and accordingly, extra working is required upon compression of the gas refrigerant. This is a cause of increase in power consumption due to leakage loss. Thus, although the leakage loss is reduced as the pressing force between the orbiting scroll and the non-orbiting scroll member is increased, the reduction in the leakage loss becomes not effective in a range in which the pressing force is greater than a certain value, and the effect of the reduction is saturated.

Next, as to the frictional loss in the slide part, the base plates and the ends of the wraps of the orbiting and non-orbiting scroll members are made into contact with one another, and are slid one upon another during operation of the compressor, and a frictional force is effected between the orbiting scroll and the non-orbiting scroll, so that the frictional force is changed as the value of backside pressure is changed. Thus, it is understood that the friction loss is also changed. The power consumption of the compressor is determined by adding these losses to the gas compression work, and if these losses are superposed with each other on the graph, a convex curve facing downwardly is obtained, that is, a local minimum is present in the power consumption. Thus, it is understood that a value which can minimize the power consumption of the compressor exists in the value of backside pressure.

Next, consideration will be made of the relationship among the force separating the orbiting scroll and the non-orbiting scroll from each other, the suction pressure and the discharge pressure. The separating force varies in accordance with a pressure distribution in the compression chamber. The pressure distribution in the compression chamber is changed in accordance with a used pressure condition. Therefore, if the internal pressure of the compressor, such as (pressure in a certain part within cycle)×(substantial constant)+(substantial constant), is simply used as a reference value, a set value for the value of backside pressure can not satisfy the entire operating pressure range of the air-conditioner since the air-conditioner is operated in a wide pressure range. Thus, a typical standard using condition which would be actually used, is set up, and the backside pressure in this condition is optimized. Accordingly, if the deviation between the operating condition of the air-conditioner and the standard condition in which the value of backside pressure is set, is large due to an installation condition which varies in dependence upon a regional difference, an atmospheric temperature or the like, the desired value for control of backside pressure is deviated from a real condition, and accordingly, the instinct performance cannot be exhibited.

Further, in order to produce heat pump apparatus which can achieve a maximum efficiency for various purposes, it is required to develop back pressure regulating mechanisms having values of back pressure which are set in accordance with used refrigerants and various conditions to produce compressors of kinds having a number equal to a maximum number of kinds of the heat pump apparatus, and accordingly, a job shop type production (multi-product and little production) is required.

In order to solve problems of such kinds, in this embodiment, the pressure in the back pressure chamber is not set to a value which is simply greater than the suction pressure by a constant value, but a power consumption of the scroll compressor is detected (which may be represented by a power consumption of the air-conditioner) and the pressure in the back pressure chamber is regulated to minimize the power consumption as possible as it can.

Referring to FIG. 1, the air-conditioner is provided therein with the control device 300 for the pressure regulator 310, which detects a tendency of change in the power consumption of the compressor, caused by variation in fluid pressure introduced into the back pressure chamber, and delivers a signal for controlling the fluid pressure in order to decrease the power consumption of the compressor in accordance with the thus detected tendency of change in power consumption, to the pressure regulator 310. The control algorithm of this control device 30 will be described.

It is noted here that the control target of the air-conditioner is to control the temperature of air in a room to a set value, by means of which the necessary heat transmission between the indoor and the outdoor is made through the refrigerant. The capacity of refrigerating cycle per unit refrigerant circulating volume is approximately determined by atmospheric temperatures of the indoor and outdoor units and a physical value of the refrigerant, and accordingly, the value of heat to be transmitted is, in general, controlled in accordance with a circulating volume of the refrigerant. Thus, there is used a method in which the circulating volume of the refrigerant is substantially changed in accordance with a rotational speed of the compressor so as to adjust the heat to a required heat value. In addition, the temperature and pressure of refrigerating cycle can be regulated in accordance with an air volume of a fan for feeding air into the heat-exchanger.

Description will be made of terminology which will be used hereinafter. Data base basically comprises a memory device. The memory device is divided into three blocks in which physical values as operating conditions such as indoor temperatures, outdoor temperatures, set temperature and the like, physical values as control conditions such as backside pressures, rotational speeds of the compressor, rotational speeds of indoor and outdoor fans, and control signals indicating opening degrees of the motor driven expansion valve, and the like, physical values as control results such as temperatures, pressures, power consumption, voltages, currents and the like are stored and respectively related to one another, thereby it is possible to obtain a control signal for an optimum condition from an operating condition. Further, a power consumption at that time can be obtained. Further, data are stored so that the relationship between the above-mentioned operating condition and the control signal is unaltered, and data of physical values indicating results of control during operation is preferably stored anytime so that a control signal obtained from an operating condition is processed in consideration with stored results of control in order to obtain a more optimum control value. It is noted that the above-calculating method may be carried out with the use of a relationship formula for the operating condition, the control signal and the results of control, and correction terms thereof.

Further, the memory stores therein with the operating conditions, the control signals and the results of control in time series, and is used for stable detection of control, resetting of a control value or the like when the power consumption of a room air-conditioner or a compressor is changed due to a variation in the value of backside pressure, or when abnormal control occurs. It is noted that the determination of stability is obtained by a deviation between a variation in a signal within a time which is constant or is changed in accordance with a control condition, and an averaged value, a comparison with a limit value obtained from the data base in accordance with an operating condition, or the like.

Further, the incorporated clock is means for obtaining a season, a date, a time and the like, and for obtaining a rest period between the previous operation and the present operation.

Further, it is preferable that the value of variation in backside pressure is variable. As mentioned above, the relationship between the power consumption and the backside pressure can be indicated by a downwardly facing convex curve. In consideration with variation in the power consumption with respect to variation in the backside pressure, since an inclination of a tangential line of the above-mentioned curve in the vicinity of a control point is obtained by the calculation of a formula:(variation in power consumption)/(variation in backside pressure), if the absolute value of the inclination becomes greater than a certain value, it is in the vicinity of a local minimum value, and accordingly, the oscillation of the control value in the vicinity of the local minimum value is restrained by decreasing the value of variation in the backside pressure, thereby it is possible to promote the conversion.

Further, as to the power consumption of the room air-conditioner as mentioned above, if the power of accessory equipment is low in comparison with the power of the compressor and so forth, a power consumption of the compressor may be measured. Further, even though the power consumption cannot be directly measured, a voltage value and a current value may be measured, instead thereof.

During control operation in which the power consumption of the compressor is lowered, if the temperature in a room, as a control object of the room air-conditioner, becomes stable in the vicinity of a desired control value, the physical values of components constituting the room air-conditioner, falls in a substantially equilibrium condition, and accordingly, a variation in the power consumption due to a variation in the value of back pressure can be simply confirmed. Thus, description will be made of a configuration for controlling the operation of the room air-conditioner when the operating condition is stable, with the use of a control algorithm shown in FIG. 4.

At first, by fixing the value of backside pressure in the orbiting scroll member 110, at the time when the indoor temperature reaches a desired temperature, the pressure in the backside pressure zone 101 in the orbiting scroll member 110 is increased (or decreased) by a certain degree of variation. Accordingly, the cooling capacity of the cycle is changed so that the indoor temperature is possibly changed. Thus, this backside pressure value is fixed and the control is made again in accordance with a rotational speed of the compressor or by the expansion valve or the like so as to set the indoor temperature to be equal to the desired control value. Thus, the indoor temperature again reaches the desired control value, and then, a power consumption at the time of the stabilization is compared with a power consumption stored before the value of backside pressure, stored in the memory, is changed.

At this time, if the power consumption of the heat pump is decreased, the value of backside pressure is again increased (or decreased) even at the next step so as to repeat the regulation to the value of backside pressure. On the contrary, if the power consumption of the heat pump is increased, the value of backside pressure is decreased (or increased), reverse to the previous step so as to repeat the regulation, thereby it is possible to continue with a change into a value of backside pressure with which the power consumption becomes small under one and the same indoor temperature. It is noted that if the valve opening degree, and the rotating position of a stepping motor which can determine the value of backside pressure are stored in the memory, the operation can be carried out with the use of the value as a minimum power consumption by returning the rotating position to a previous position before the power consumption is increased.

Figure 4:
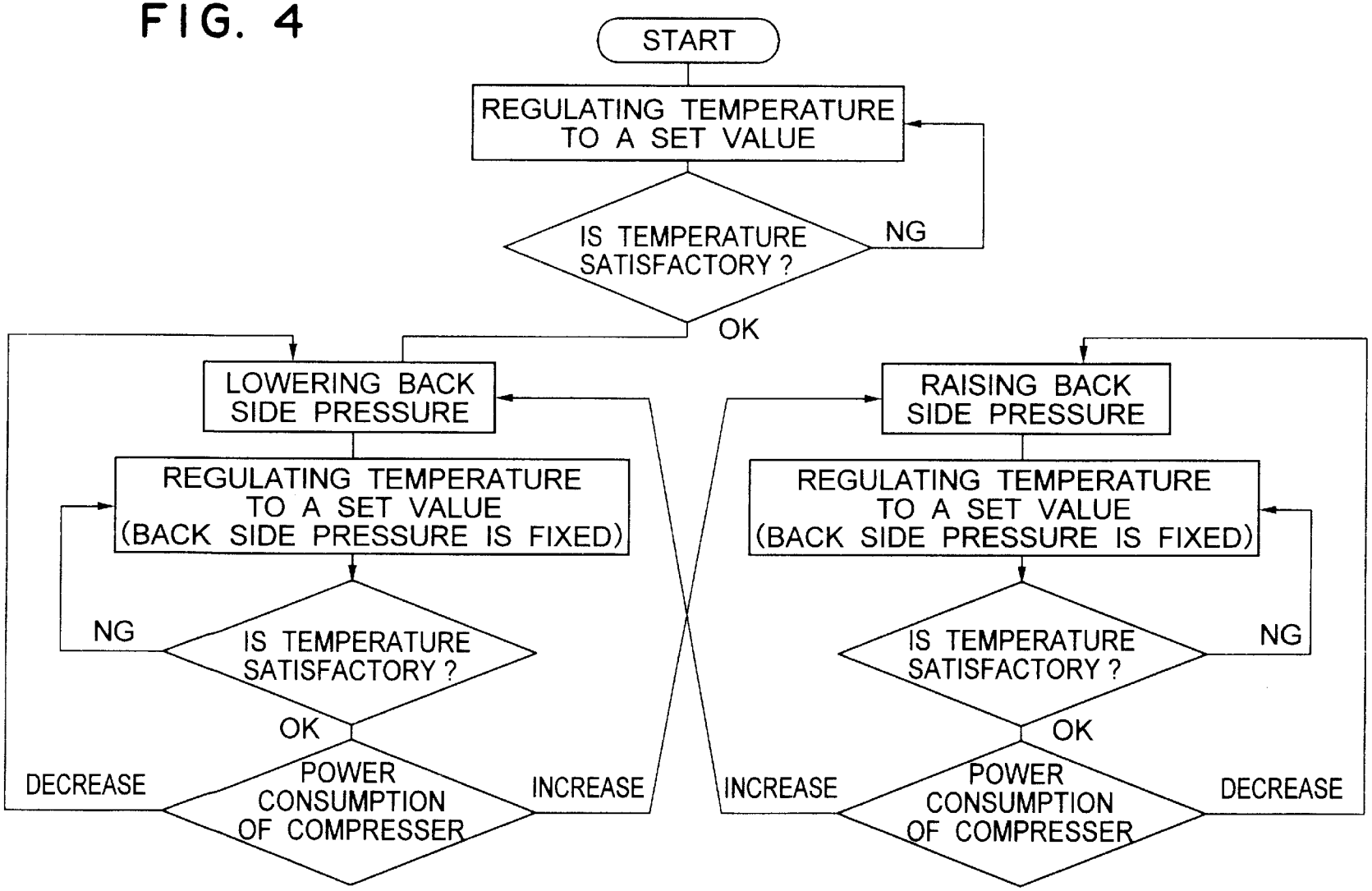
FIG. 4 is a flow-chart showing a control algorithm for a backside pressure.

It is noted that although the direction in which the backside pressure is initially changed upon starting, is in a direction in which it is decreased in the algorithm shown in FIG. 4, similar control can be carried out only along a different path even in a direction in which it is increased. Further, if a direction in which the value of backside pressure is changed during a rest period, and which has been stored in memory is used as a changing direction just after starting, it is sometime possible to converge the control of power consumption in a short time.

As mentioned above, in addition to the indoor temperature, operating condition detecting means are provided for temperatures, pressures and refrigerant flow rates of components of the air-conditioner, such as a compressor, a heat-exchanger and pipe lines, for voltages, currents and powers effected in the entire room air-conditioner and the compressor, and for rotational speeds of the compressor, and then, at lest more than one of these items measured by the detecting means are used for determination by utilizing signals obtained from the various sensors.

Next, the mechanism of the regulating valve will be described with reference to FIG. 6. In the configuration of this embodiment, an example of the regulating arrangement using a planar valve will be discussed. A backside pressure zone (back pressure chamber) is set on the rear surface of the orbiting scroll 110. The discharge pressure in the sealed container is introduced into the back pressure chamber with the value of the pressure being decreased, through the gap between the shaft and the frame 130 or the gap in the bearing in the orbiting scroll members 110 as described above. Further, flow passages 126, 127 communicated with the suction pressure are formed in the non-orbiting scroll member 120. A disc-like back pressure valve 123 as an opening and closing mechanism for changing the flow resistance of the passage is provided in the flow passages 126, 127 communicated with the suction pressure, and the back pressure valve 123 is applied at its one surface with a force by the suction pressure and a force in a direction in which the valve 123 is sealed by a resilient member such as a spring 124 for changing a condition of opening and closing of the back pressure valve 123. The back pressure valve 123 has, at it's the other surface, a structure such that a force by the backside pressure is applied to this surface. A spring retainer 125 for changing the length of the spring 124 (changing the spring force) is arranged on the non-orbiting scroll member 120 side so as to constitute a regulating mechanism for a back pressure valve. By changing the position of the spring retainer 123, the spring force is changed so that the valve pressing force is changed, and accordingly, the valve is opened so as to reduce the backside pressure when a differential pressure is effected by the backside pressure which is greater than the sum of the suction pressure and the spring force. This structure is advantageous in that the spring force can be exhibited by a function depending upon a degree of depression irrespective of whether its spring characteristic is linear or nonlinear, and accordingly, the differential pressure between the set backside pressure and the suction pressure can be obtained substantially under open-loop control without using a detecting means such as a pressure sensor, in the case of combination with a drive source such as a stepping motor. As to the spring, not only a coil spring but also other springs including a leaf spring and a Belleville spring or another resilient member can be used.

Figure 7:
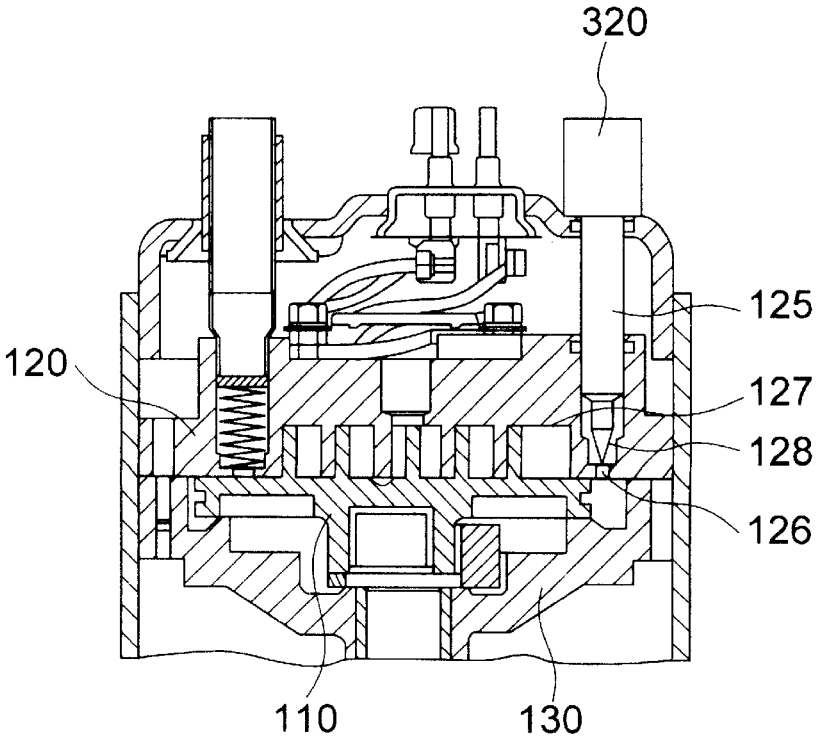
FIG. 7 is a view illustrating a 2nd embodiment of a backside pressure control arrangement.

Referring to FIG. 7, another example of the regulating mechanism for the back pressure valve will be described. In this example, a needle valve regulating mechanism is used. Similar to the arrangement as mentioned above, the backside pressure zone is set on the rear surface of the orbiting scroll member 110. The discharged pressure from the sealed container is fed into the backside pressure zone, through the gap between the shaft and the frame, or the gap in the bearing in the orbiting scroll member 110, after the value of the pressure is lowered. Flow passages 126, 127 communicating the backside pressure with the suction pressure are formed in the non-orbiting scroll member 120, and a substantially cylindrical needle for changing the flow resistance of the passage and a structure for sealing with an end face or a side surface of the needle are provided in the flow passages 126, 127 communicated with the suction pressure.

Figure 8:
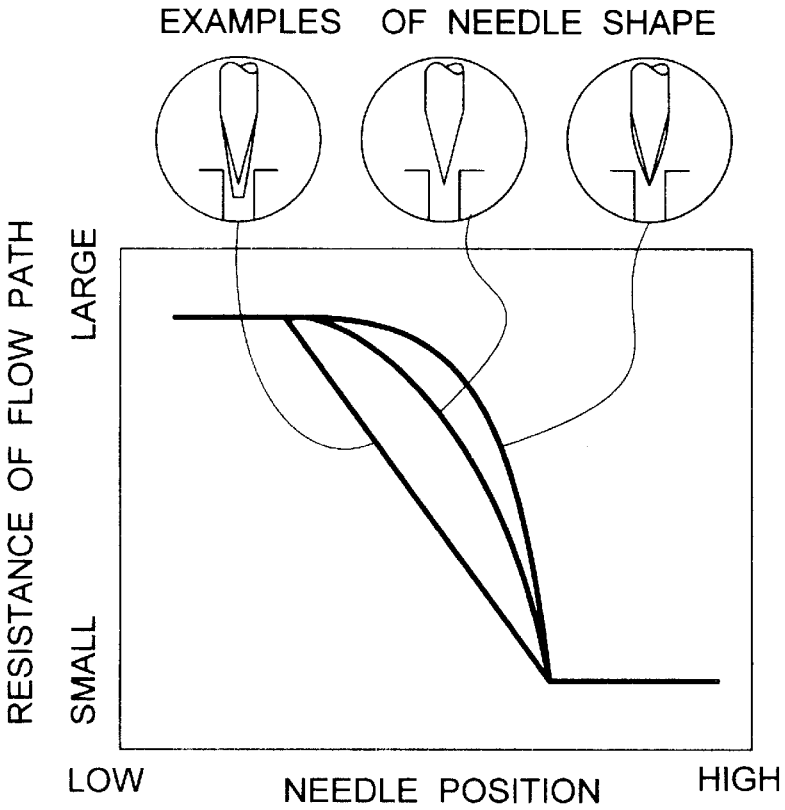
FIG. 8 is a view illustrating a 3rd embodiment of a backside pressure control arrangement.

By selecting a shape of the needle, the relationship between the needle and the flow resistance can be variously changed in response to needs. This relationship is shown in FIG. 8. Due to a difference in shape of the needle in the axial direction, it is understood that the relationships among the vertical displacement of the needle and the seal surface and the gap between the seal surface and the needle are changed as indicated by curves shown in FIG. 8.

Figure 17:
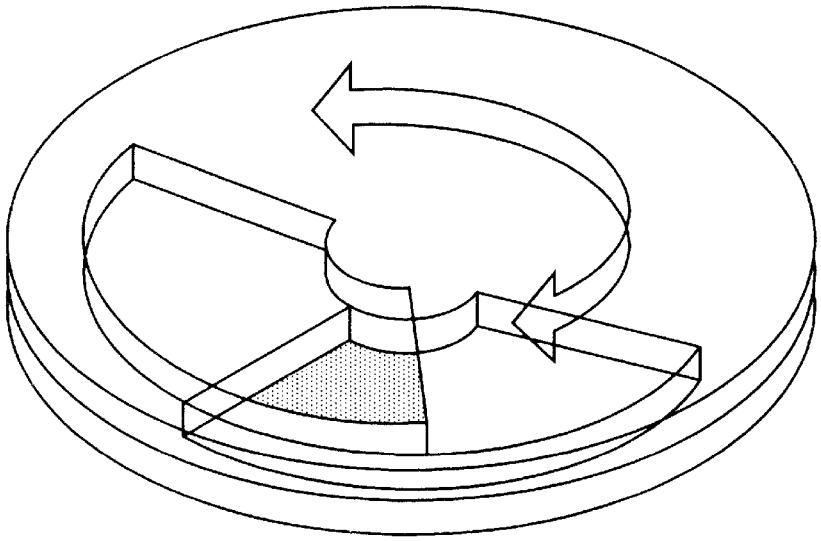
FIG. 17 is a view illustrating a 12th embodiment of a backside pressure control arrangement.
Figure 18:
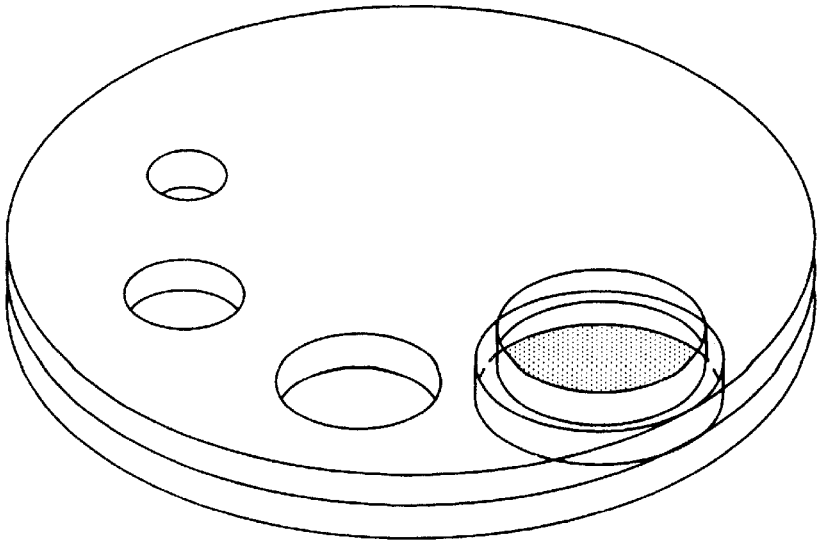
FIG. 18 is a view illustrating a 13th embodiment of a backside pressure control arrangement.

Other examples of the above-mentioned pressure regulating mechanism will be described hereinafter with reference to FIGS. 17 to 18 in which rotary valves are shown. These rotary valves are advantageous in that they can be easily installed in a narrow space, and since no oscillating or pulsating parts are present, noise can hardly be issued. A rotary valve shown in FIG. 17 is a mechanism for continuously changing the opening area, and a rotary valve shown in FIG. 18 is a mechanism for stepwise changing the opening area. Since the latter is the mechanism for stepwise changing the opening area, it is advantageous in that the set value can be clearly and surely obtained without measuring the value of backside pressure in such a case that the rotary valve is rotated by a step motor. Either of the valve can regulate the pressure in the back pressure chamber by changing the flow resistance of passage.

By the way, in the case of the provision of the control mechanism outside of the sealed container of the compressor, a packless valve or a motor driven expansion valve which are commercially available can be used.

Further, the control mechanism requires such a characteristic that the backside pressure is monotonously increased or decreased between the fully opening position and the fully closing position in order to make the control convenient. As mentioned in the configuration of the embodiment, this is because that it can be carried out by increasing and decreasing from the previous control of the back pressure valve, and it is determined whether the directivity of the changing is effective or not for reducing the power consumption thereof so that the tendency of changing at the next time is set to be identical, thereby the directivity of the control can hardly be determined if a point of inflection is present in the process of the variation.

Figure 10:
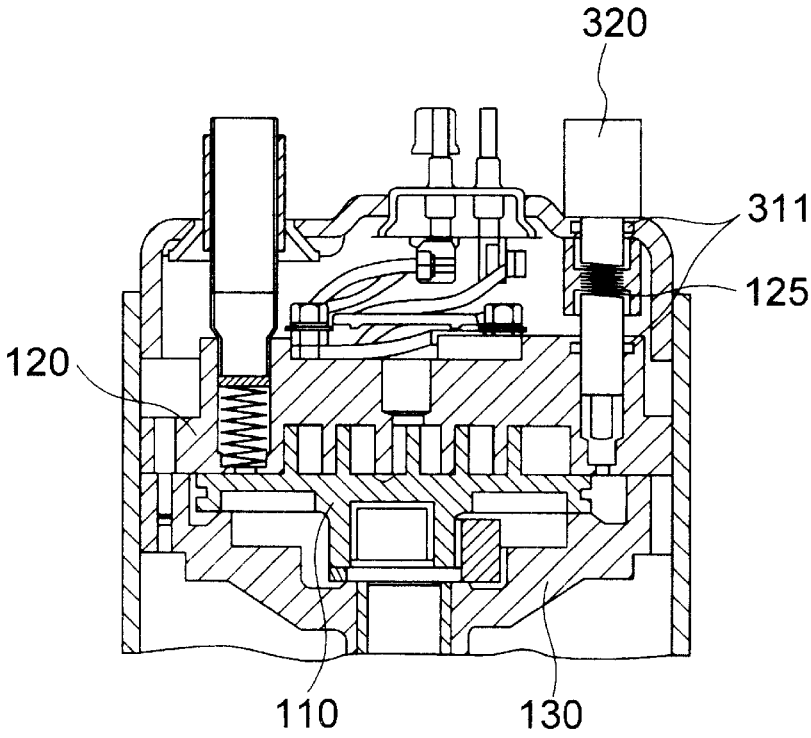
FIG. 10 is a view illustrating a 5th embodiment of a backside pressure control arrangement.

The drive device for the pressure regulating valve in the pressure regulating mechanism 310 will be described with reference to FIG. 10. A screw and a stepping motor are used as shown in FIG. 10, as a drive device for the pressure regulating mechanism composed of the above-mentioned planar valve and the needle valve. A female thread is formed in the non-orbiting scroll member 120, and a male thread is formed in the spring retainer coupled to the stepping motor 320, and is meshed with the female thread. With this arrangement, the stepping motor is rotated so that the spring retainer is moved up and down. It is advantageous in that the degree of depression of the spring can be known by the stepping motor even under open-loop control.

As to other drive devices, a linear motor, a solenoid, a cylinder mechanism actuated by fluid pressure, an ultrasonic motor, a shape memory alloy in combination with a heating and cooling device or the like may be used. In the case of the packless valve attached outside of the compressor, a rotary motor can be attached to the rotary shaft of the valve.

According to the embodiments as mentioned above, in a stable condition in which the indoor temperature of the air-conditioner is balanced with the set temperature, the pressure of the back pressure chamber is regulated so as to lower the power consumption, and accordingly, the measured value of the power consumption is not changed by any of factors other than the pressure in the back pressure chamber, thereby it is possible to restrain the pressure control system in the back pressure chamber from being unstable. Accordingly, the pressure in the back pressure chamber can be regulated to a value with which the power consumption would be minimized. Accordingly, the power consumption can be restrained through the entire refrigerating cycle.

Figure 5:
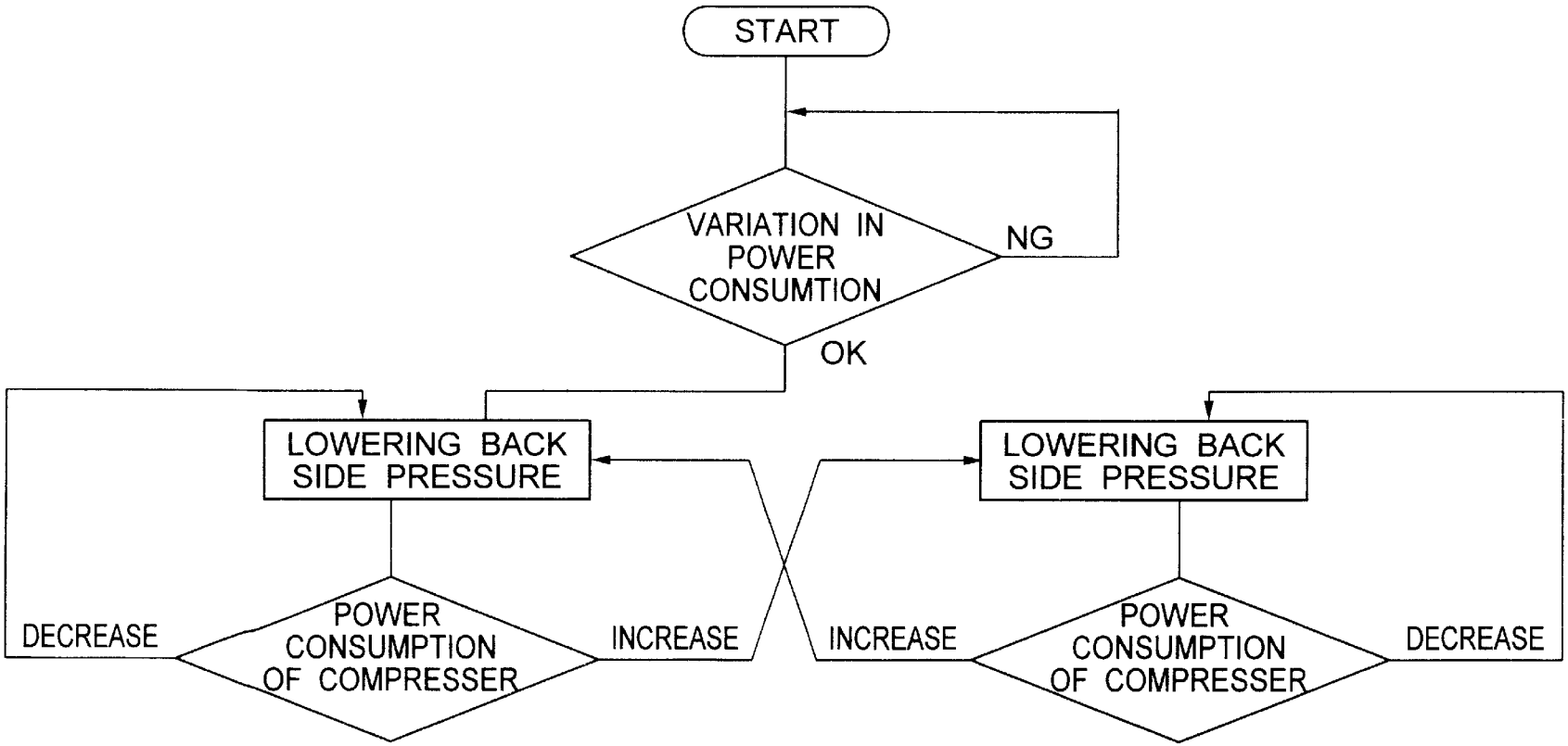
FIG. 5 is a flow-chart showing a control algorithm for a backside pressure.

Under the control in which the power consumption of the compressor is lowered, in such a case that the operating condition of the room air-conditioner is an non-equilibrium condition, a variation in the power consumption of the room air-conditioner, caused by a factor other than the value of backside pressure is included even though the backside pressure is merely changed, and accordingly, the evaluation becomes difficult as it is. In the configuration of the above-mentioned first embodiment, the pressure in the back pressure chamber is regulated at such a stage that the operating condition of the air-conditioner becomes an equilibrium condition, but in the configuration of the second embodiment, the pressure in the back pressure chamber can be adjusted even in the non-equilibrium condition. This control algorithm will be described with reference to FIG. 5.

For example, such a case that the operating condition of the air-conditioner is likely to fall in the non-equilibrium condition, occurs if the deviation between the set temperature and the indoor temperature becomes larger. In such a case that the temperature deviation is relatively large, since the rotational speed of the compressor is limited, or in such a case that the compressor is rotated at the constant speed, the power consumption of the compressor is shifted with a substantially constant value without the temperature control falling in an equilibrium condition.

Accordingly, in the configuration of this embodiment, the power consumption of the compressor is obtained from an input voltage and an input current to the compressor, and whether the peak-to-peak of the power consumption falls within a predetermined range or not is determined. If it falls in this range, it is determined that the variation in the consumption power is small, and accordingly, the pressure in the back pressure chamber is changed, similar to the first embodiment, and if the power consumption before the change is greater than that after the change, this changing direction is continued until the relationship of the consumption power is inverted. According to the configuration of the present embodiment, if it is applied in, for example, an air-conditioner, the determination is made such that the power consumption is not changed by a factor other than the control of the pressure in the back pressure chamber, with a high degree of possibility, even though the temperature control system falls in an equilibrium condition, and also in this case, there may be presented such an advantage that the control of the pressure in the back pressure chamber can be carried out in a direction in which the power consumption can be decreased. It is noted that if the control of the pressure in the back pressure chamber in the first embodiment is combined with the configuration of this embodiment, the control of the pressure in the back pressure can be carried out even in the equilibrium condition (the temperature control in the equilibrium condition exhibits that the variation in the power consumption is small, and accordingly, the control in the configuration of the first embodiment can be carried out).

Of the above-mentioned first and a second embodiments, the control of the pressure in the back pressure chamber cannot be carried out in the first embodiment only after the complete equilibrium condition is effected, and further while the control of the pressure in the back pressure chamber can not be carried out in the second embodiment only when the variation in the power consumption is small. However, in the configuration of a third embodiment which will be described hereinafter, it can be determined how the result of variation in the pressure in the back pressure chamber affects upon the power consumption even though the pressure in the back pressure chamber is changed while the power consumption varies, and accordingly, the control of the pressure in the back pressure chamber can be carried out even in any operating condition.

As to physical values indicating an operating condition of the air-conditioner, in addition to the indoor temperature, there are provided operating condition detecting means for temperatures, pressures and refrigerant flow rates on the room air-conditioner components including a compressor, a heat-exchanger, a fan, a thermal expansion valve and pipe lines, and detecting means for voltages, currents, powers on the entire air-conditioner and the compressor, and means for detecting a rotational speed of the compressor, and the like. Further, there is provided data base in which the physical values exhibiting the operating conditions and the power consumption of the room air-conditioner device are related together.

Since the theory with respect to an ideal compressor has been established, a power consumption of the ideal compressor at a certain time can be obtained from Mollier chart when the physical values are measured in the refrigerating cycle. That is, a suction gas temperature, a temperature upstream of the expansion valve, a compressor rotational speed (refrigerant flow rate), compressor suction pressure and a compressor discharge pressure are measured, and thus measured values are substituted into the data base or an empirical formula by which they are related to a power consumption of the room air-conditioner, to obtain a power consumption at the time of measurement for the ideal compressor.

This ideal power consumption and the power consumption of an actual compressor (which can be obtained from an input current and an input voltage) are stored in the memory, and the pressure in the backside pressure zone 101 of the orbiting scroll 110 is increased (or decreased). If the loss of the compressor is decreased even in consideration with a variation in the power consumption, that is, if the actual power consumption of the compressor after the pressure in the back pressure chamber is changed approaches the ideal power consumption, further increasing (or decreasing) is made so as to carry out the regulation. On the contrary, if the loss of the compressor is increased (if the actual power consumption of the compressor goes way from the ideal power consumption), decreasing (or increasing) is made so as to obtain a tendency reverse to that mentioned above, thereby it is possible to control such that the backside pressure becomes the pressure which the loss becomes the smallest.

Further, if the correcting function for the above-mentioned data base is used, the degree of accuracy for the above-mentioned ideal power consumption can be enhanced, thereby it is possible to decrease the power consumption.

In the first to third embodiments, when the conditions for changing the backside pressure have been completely prepared and the backside pressure is changed, if the power consumption is greatly changed, it is clear that this is not caused by changing the backside pressure. If this condition is left as it is, it cannot be determined what condition the backside pressure is controlled into, and accordingly, the control of the backside pressure becomes unstable. An example with which the unstable condition is restrained will be described hereinafter.

There is provided a memory device for previously storing control values including a rotational speed of the compressor, an opening degree of the expansion valve and rotational speeds of fans in the indoor and outdoor units of a room air conditioner before the backside pressure is changed. When the backside pressure is to be changed, the backside pressure is changed so as to decease the power consumption of the air-conditioner to carry out control so that the indoor temperature can approach the control target value.

If the indoor temperature and the power consumption of the room air-conditioner are abruptly changed due to a variation in thermal load caused by ventilation, entrance and exit of a person or defrosting in heating operation, during control to stabilize the indoor temperature, and if the absolute value thereof or a variation per unit time exceeds a predetermined value which is determined from the physical value indicating the operating condition by using the data base, it is judged that the control of the pressure in the back pressure chamber cannot converge to the target value. In other words, if the variation in the power consumption for the control value of the backside pressure greatly exceeds a variation value which can be theoretically obtained, it is determined that the large variation in the power consumption is not caused by carrying out the control of the backside pressure, but caused by another factor. That is, there is provided such a determining function that the absolute value of the power consumption of the compressor or the room air-conditioner and a variation per unit time are monitored and when at least one of these values exceeds a set value, it is judged as abnormal.

At this time, in order to avoid occurrence of unstableness in the control of the backside pressure, a compressor rotational speed, an expansion valve opening degree, rotational speeds of fans in the indoor and outdoor units and a value of backside pressure (a position of the step motor) of the room air-conditioner are previously stored in memory before the backside pressure is changed, and then, such control for the room air-conditioner is carried out that the control values are returned to set values which have been stored in memory before the back pressure is changed.

Further, a fourth embodiment to change the backside pressure will be described. During operation of the scroll compressor, the orbiting scroll is orbited relative to the non-orbiting scroll with a certain radius, without revolving around its own axis. At this time, the position, the shape and the pressure of the crescent-like compression chambers defined between the orbiting scroll wrap and the non-orbiting scroll wrap varies with rotation. Further, the magnitude of a force in a direction in which the orbiting scroll and the non-orbiting scroll are separated from each other is changed cyclically as the rotation is advanced. For example, in a case where the pressure of the discharge port is higher than the pressure just before the discharge of the compressor in dependence on the operation condition, when the innermost compression chamber is communicated with the discharge port, the pressure in the compression chamber becomes higher so that the separating force would be abruptly increased.

In order to solve this problem, with the configuration of this embodiment, the value of backside pressure is varied in association with the rotation of the compressor in order to set the value of backside pressure to a minimum required value. A variation in the pressure of the compressor per revolution of the compressor can be detected, and accordingly, data base indicating a relationship between the rotating position and the backside pressure is built up so that the backside pressure is regulated on the basis of the data base. With the configuration of this embodiment, it is possible to aim at achieving the power saving.

As having been described above, it is necessary to mount a certain drive source to the scroll compressor in order to drive the regulating valve for regulating the backside pressure. Next, the mounting position of the drive source will be described.

Figure 9:
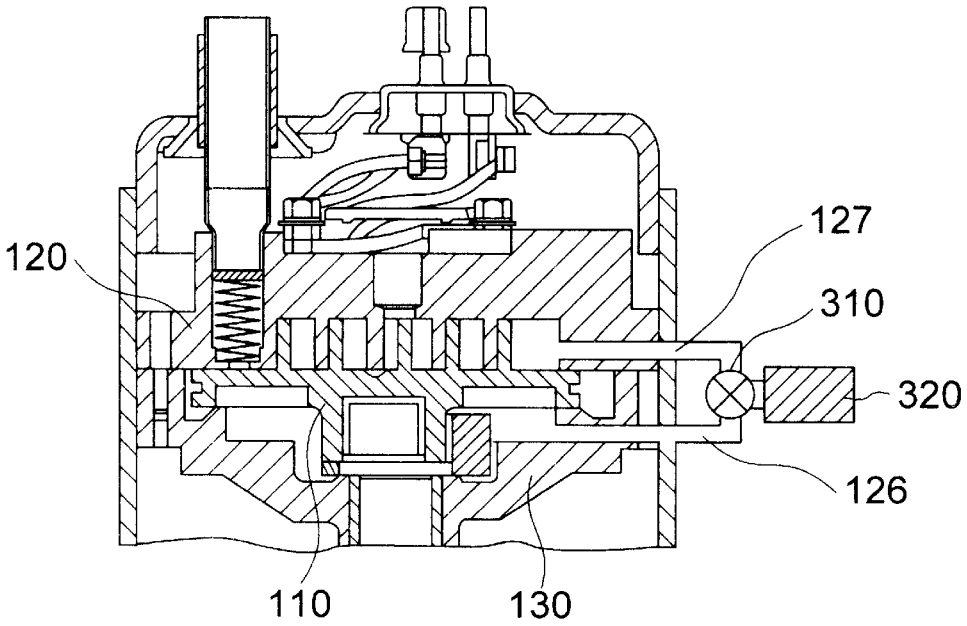
FIG. 9 is a view illustrating a 4th embodiment of a backside pressure control arrangement.

In the scroll compressor shown in FIG. 9, the pressure regulating mechanism is provided outside of the sealed container and the drive device is provided outside thereof. With this arrangement, it is convenient in such a case that a mounting space can hardly be ensured within the sealed container. Further, since it is only necessary to seal a valve, the number of sealing parts for enhancing the sealing performance can be decreased.

Further, in the scroll compressor shown in FIG. 10, the pressure regulating mechanism is provided in the sealed container while the drive device is provided outside thereof. In this case, a rod coupled to the drive device is required in the non-orbiting scroll member, and accordingly, the discharge pressure is applied to the drive device side part of the rod while the suction pressure and the backside pressure are applied in the non-orbiting scroll member. Thus, since a differential pressure is induced, sealing is made between the non-orbiting scroll member and the rod. Similarly, sealing is made between the sealed container and the rod side.

Figure 11:
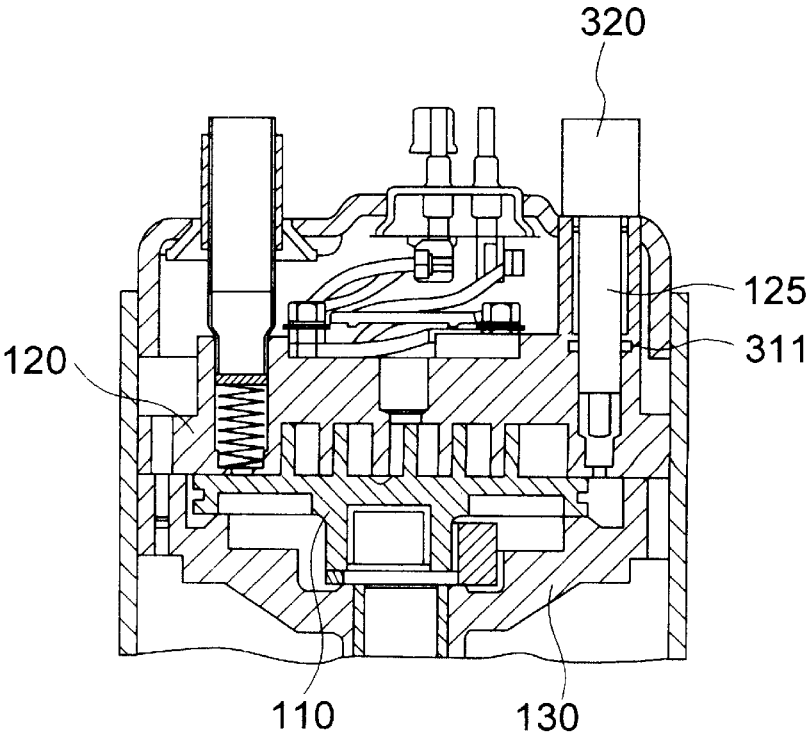
FIG. 11 is a view illustrating a 6th embodiment of a backside pressure control arrangement.

The scroll compressor shown in FIG. 11, is another example in which the pressure regulating mechanism is provided in the sealed container while the drive device is provided outside thereof, and which is the same as that shown in FIG. 10, except that a part of the non-orbiting scroll member is extended toward the casing and is joined thereto by welding in order to eliminate the necessity of sealing between the drive device and the sealed container. With this arrangement, the seal-up can be made by press-fitting or the like so as to reduce the number of sealing positions from two to one, thereby it is possible to provide a structure which is more advantages for preventing leakage of refrigerant. It is noted that such a structure that the sealed container side is extended so as to be joined to the non-orbiting scroll member may be used for achieving the same purpose.

Figure 12:
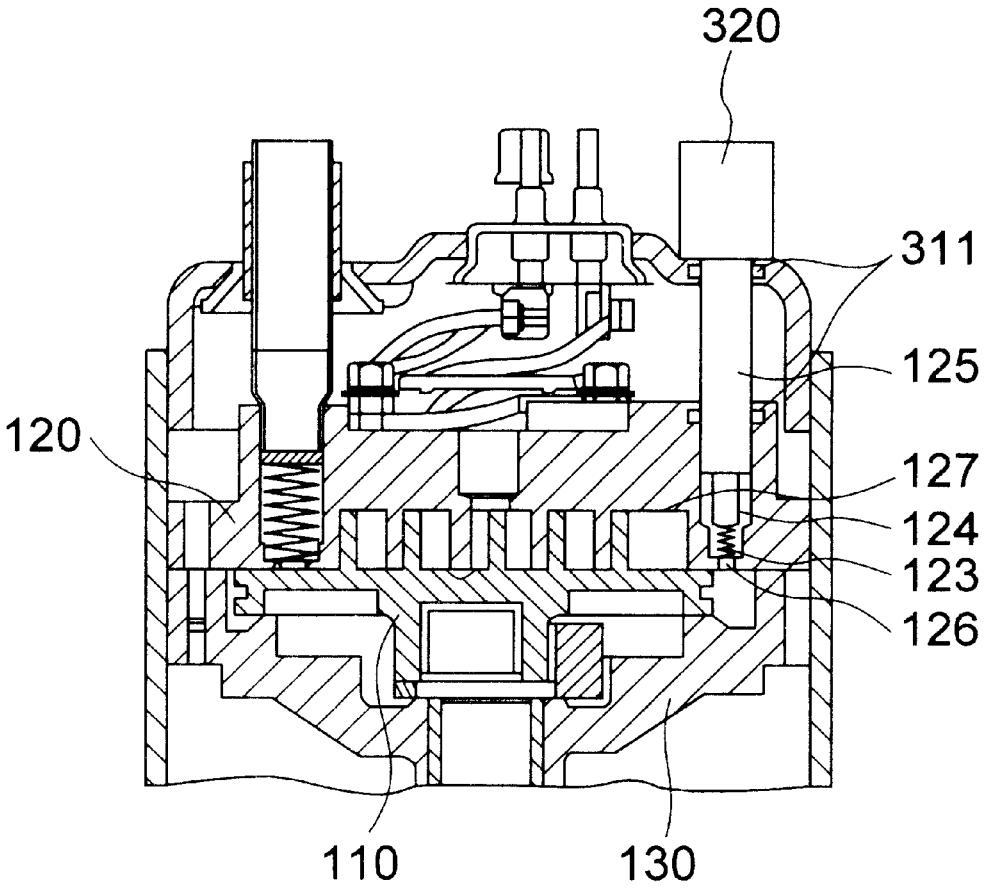
FIG. 12 is a view illustrating a 7th embodiment of a backside pressure control arrangement.

FIG. 12 shows an example in which the pressure regulating mechanism and the drive device are provided in the sealed container. In the relationship between the non-orbiting scroll member and the rod is similar to that shown in FIG. 10, that is, a sealing means is incorporated between the orbiting scroll member and the rod.

Figure 13:
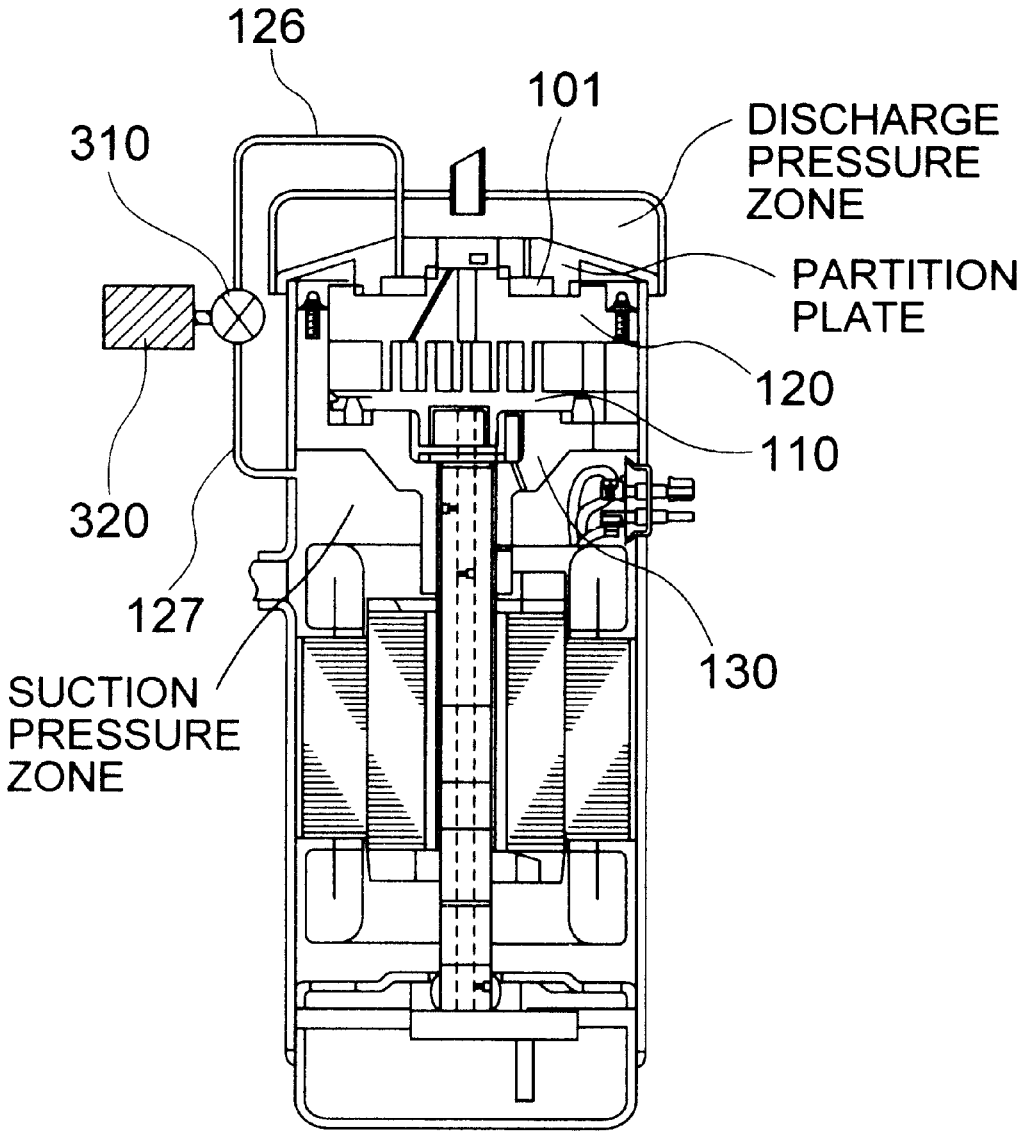
FIG. 13 is a view illustrating an 8th embodiment of a backside pressure control arrangement.

By the way, the configuration of the embodiment shown in FIG. 13 is an example in which the present invention is applied in a scroll compressor of such a type that the non-orbiting scroll member is movable (that is, a stationary scroll is releasable). In the drawing, a partition plate is provided in the upper part of the non-orbiting scroll member 120. With this arrangement, the discharge pressure is exerted to the upper part of the partition plate while the suction pressure is exerted to the lower part thereof, and the backside pressure is applied in the gap between the partition plate and the non-orbiting scroll member 120. The backside pressure is led through the backside pressure introducing passage 126, and the suction pressure is introduced through the suction pressure introducing passage 127 so that both pressures are discharged outside of the compressor. Further, the compressor is connected to the packless valve serving as the regulating means 310, and then is coupled to the driving stepping motor.

Figure 14:
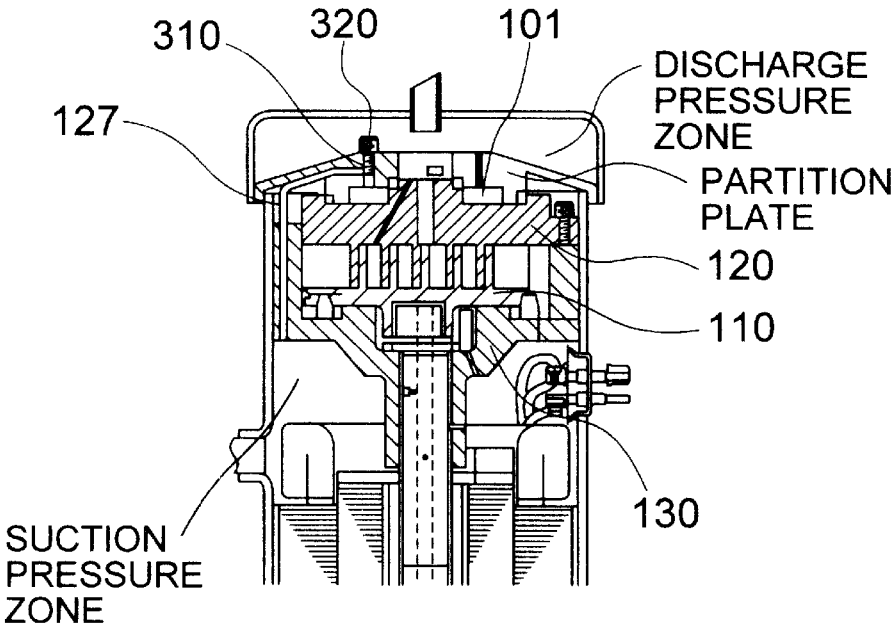
FIG. 14 is a view illustrating a 9th embodiment of a backside pressure control arrangement.

If the pressure regulating valve is incorporated in the sealed container, as shown in FIG. 14, at least one of the backside pressure and the suction pressure may be introduced to the orbiting scroll member by providing passage in the non-orbiting scroll member, the frame and the partition plate or pipe.

Figure 15:
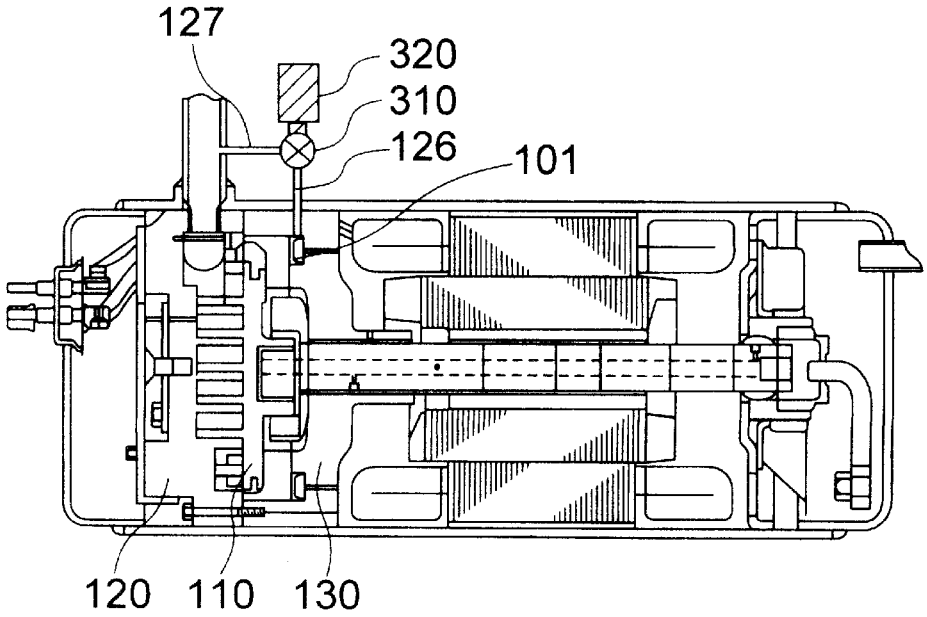
FIG. 15 is a view illustrating a 10th embodiment of a backside pressure control arrangement.
Figure 16:
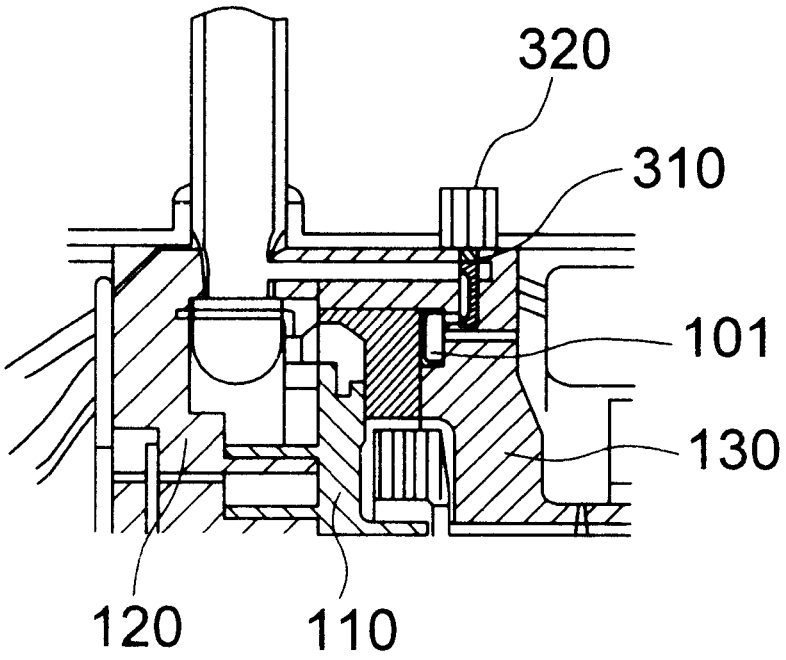
FIG. 16 is a view illustrating an 11th embodiment of a backside pressure control arrangement.

In a method of producing a force for pressing the orbiting scroll member 110 against the non-orbiting scroll member 120 as shown in FIG. 15, a pressure is exerted to the rear surface of a ring provided in the orbiting scroll member on the side opposite to the compression chamber and the pressing force is transmitted to the orbiting scroll member through the ring, thereby it is possible to obtain a similar function. It is noted that the example shown in FIG. 16, is such an example that the control mechanism is incorporated in the compressor shown in FIG. 15.

As to the above-mentioned sealing means, an O-ring, a resin packing, a mechanical seal, and effects obtained by a clearance between components, and by an oil may be used.

According to the configurations of the various embodiments as mentioned above, in the heat pump apparatus, the value of backside pressure is regulated so as to minimize the power consumption of the compressor without changing the set temperature as an control object under the operating condition with a wide pressure ratio range in comparison with such a case that, with respect to only one typical operating condition among the operating conditions, the value of backside pressure in at least either one of the orbiting scroll member and the non-orbiting scroll member in the compressor is set to a value which is obtained by the formula: (pressure in a certain part in cycle)×(substantially constant value)+(substantially constant value), and accordingly, it is possible to aim at exhibiting power saving.

Further, in respective equipment themselves of refrigerators, also in a device which can be operated in a semi-fixed operating condition, even in a such case that differences in condition among the equipment are considered to be large due to installation conditions, an object having a temperature to be controlled and differences among set temperatures, a range which can be covered by one kind of a compressor is widened, and a number of kinds of equipment to be manufactured can be reduced, thereby it is possible to aim at reducing the cost due to a mass production base.

Figure 19:
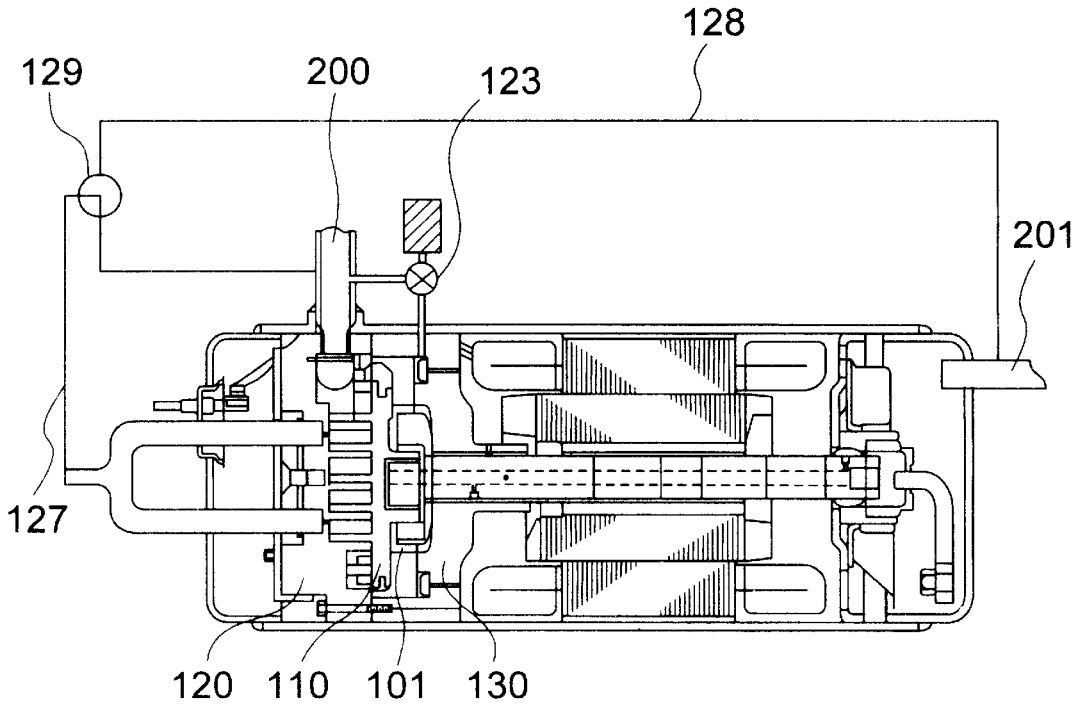
FIG. 19 is a view illustrating an example of a compressor which carries out capacity control.

Next, the configuration of an embodiment of a heat pump apparatus in which a scroll compressor for carrying out load control is installed will be described with reference to FIG. 19.

The capacity control reduces the volume upon initiation of compression for normal operation. Accordingly, the compression chamber is communicated with the suction pressure space during a period extending from a position where the compression is initiated, to a position where a desired volume can be obtained under the capacity control in the normal operation mode, so as not to compress the refrigerant.

As an example, a check valve is provided in the base plate part of the non-orbiting scroll member 120, and the suction pressure introducing passage 127 and the discharge pressure introducing part 128, which are communicated with a valve element in the check valve on the side opposite to the compression chamber, and a change-over means 129 for selectively introducing the flow passage, are provided in order to open and close the valve element.

With this arrangement, during maximum capacity operation, discharge pressure is exerted from the side opposite to the compression chamber upon the check valve to close the check valve for carrying out the operation, and during the capacity operation, suction pressure is exerted from the side opposite to the compression chamber upon the check valve to open the check valve to bypass the refrigerant during compression stroke to the suction pressure zone for carrying out operation with a reduced load. Further, the control of the backside pressure is carried out for optimization during normal operation and during capacity control.

Figure 20:
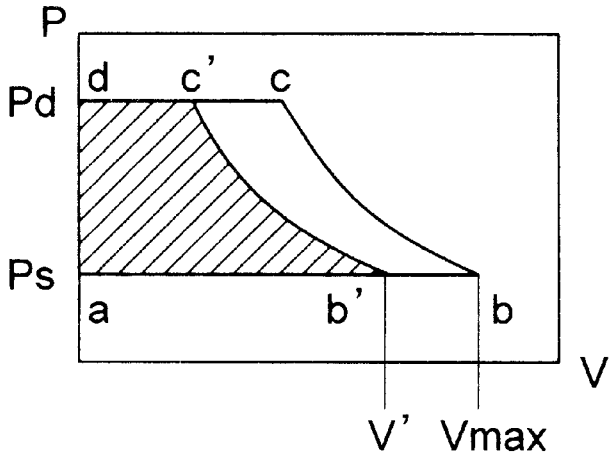
FIG. 20 is a P-V diagram during capacity control.
Figure 21:
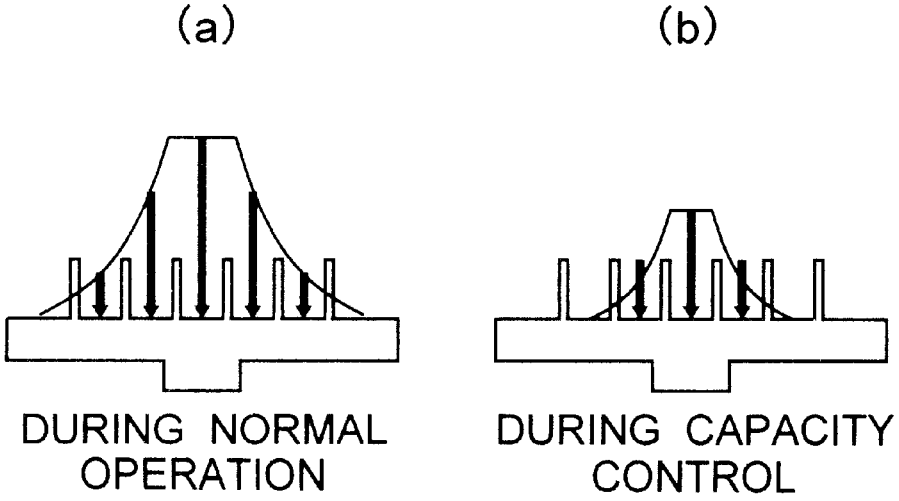
FIGS. 21*a* and 21*b* are views showing a pressure distribution in a compression chamber during normal operation and capacity control operation.
Figure 22:
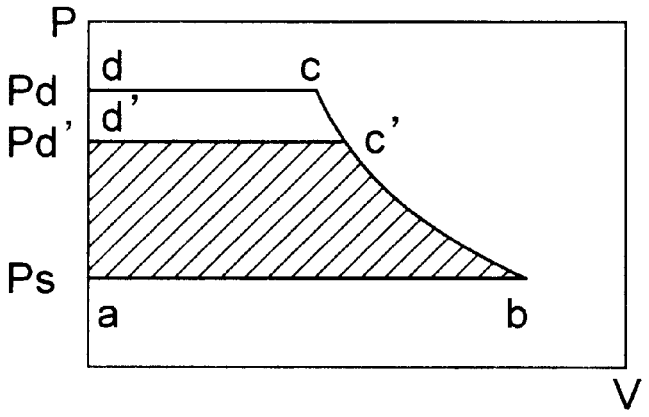
FIG. 22 is a P-V diagram during pressure ratio control.

Thus, in such a compressor which carries out capacity control, a force given by a pressure in the compression chamber varies in response to a variation of piston displacement and a pressing force required for causing the orbiting scroll and the non-orbiting scroll close to each other also varies. Here, it is estimated for the sake of convenience that the operation with a maximum piston displacement which is geometrically defined in the compressing mechanism part is the normal operation, and the operation with a reduced piston displacement is the capacity control operation. FIG. 20 shows PV chart for these operations. In the capacity control operation (a-b'-c'-d) in comparison with the normal operation (a-b-c-d), the pressure distribution in the compression chamber is as shown in FIG. 22, and it is understood that the force for pressing the orbiting scroll member and the non-orbiting scroll member against each other, which is required during the capacity control, is reduced.

Accordingly, with the value of pressure in the pressure chamber, which is optimized during the normal operation, the force for pressing the orbiting scroll and the non-orbiting scroll against each other becomes excessive, so that the slide loss increases, and accordingly, the effect of lowering the power consumption under load control is reduced.

Thus, if the back pressure regulating mechanism for the scroll compressor as mentioned above is incorporated for this compressor, the back pressure is controlled in optimum with respect to a pressure in the compression chamber in comparison with a scroll compressor in which no capacity control is incorporated.

Further, similar to the scroll compressor in which the above-mentioned capacity control is incorporated, there is a scroll compressor incorporating an excessive compression preventing mechanism, in which the pressure in the compression chamber greatly varies. In this compressor, a though-hole communicated with a discharge chamber is provided in the compression chamber on the way of compression, in addition to a discharge port, and a relief valve is provided in the through-hole. Thus, if the pressure becomes higher than the discharge pressure on the way of compression such as liquid refrigerant compression, the scroll wraps or the like are damaged by the pressure because in the scroll compressor with no through-hole, excessively compressed refrigerant has not its relief passage. However, in the scroll compressor with the through-hole (incorporated therein with a relief valve), when the pressure in the compression chamber on the way of compression becomes higher than the discharge pressure, the relief valve is opened and the pressure is relieved.

Figure 23:
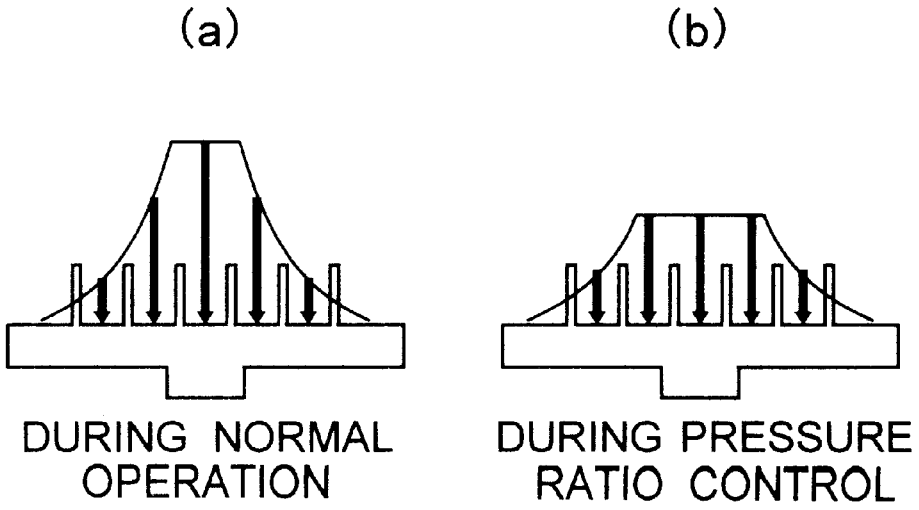
FIGS. 23*a* and 23*b* are views showing a pressure distribution in a compression chamber during normal operation and pressure ratio control operation.

Thus, in the scroll compressor incorporating the excessive compression preventing mechanism, during normal operation (a-b-c-d), the pressure in the vicinity of the discharge port becomes highest and the pressure is gradually lowered toward the periphery thereof as shown in FIG. 23*a*. On the contrary, during pressure ratio control (a-b'-c'-d) which is the excessive pressure preventing operation, since the relief valve is opened, the pressure distribution in the compression chamber exhibits such that the top of a crest is cut, as shown in FIG. 23*b*, in comparison with the pressure distribution during the normal operation. That is, it is understood that the force with which the orbiting scroll member and the non-orbiting scroll members are pressed against each other, required during pressure ration control, is decreased.

With the provision of the back pressure regulating mechanism in the scroll compressor incorporating this excessive pressure preventing mechanism, the back pressure is automatically regulated, similar to that mentioned above, thereby it is possible to reduce the power consumption.

As mentioned above, according to the present invention, there can be presented a heat pump apparatus with decreased power consumption.

What is claimed is:

1. A heat pump apparatus comprising: a scroll compressor including an orbiting scroll member in which a spiral wrap is formed on a first base plate, and an non-orbiting scroll member in which a spiral wrap is formed on a second base plate and a back pressure chamber for introducing pressure into a side of the orbiting scroll member or the non-orbiting scroll member opposite to a compression chamber formed by said orbiting and non-orbiting scroll members; a heat-exchanger; an expansion device; means for detecting a consumption power of said heat pump apparatus or said compressor; and means for changing the pressure in the back pressure chamber in accordance with an output from the detecting means.

2. A heat pump apparatus comprising: a scroll compressor including an orbiting scroll member in which a spiral wrap is formed on a first base plate, and an non-orbiting scroll member in which a spiral wrap is formed on a second base plate, a back pressure chamber for introducing pressure into a side of the orbiting scroll member or the non-orbiting scroll member opposite to a compression chamber formed by said orbiting and non-orbiting scroll members, a communication passage communicating the back pressure chamber with a suction pressure zone and a valve incorporated in the communication passage; a heat-exchanger; an expansion device, detecting means for detecting a power consumption of said heat pump apparatus or said compressor; and means for changing an opening and closing condition for said valve in accordance with an output from said detecting means.

3. A heat pump apparatus for controlling a temperature of an object to be thermally controlled to a set temperature, said heat pump apparatus comprising: a scroll compressor including an orbiting scroll member in which a spiral wrap is formed on a first base plate, and an non-orbiting scroll member in which a spiral wrap is formed on a second base plate and a back pressure chamber for introducing pressure into a side of the orbiting scroll member or the non-orbiting scroll member opposite to a compression chamber formed by said orbiting and non-orbiting scroll members; a heat-exchanger; an expansion device; and means for detecting a consumption power of said heat pump apparatus or said compressor to change the pressure in the back pressure chamber so as to decrease the power consumption when said temperature control substantially reaches a substantially equilibrium condition.

4. A heat pump apparatus comprising: a scroll compressor including an orbiting scroll member in which a spiral wrap is formed on a first base plate, and an non-orbiting scroll member in which a spiral wrap is formed on a second base plate, and a back pressure chamber for introducing pressure into a side of the orbiting scroll member or the non-orbiting scroll member opposite to a compression chamber formed by said orbiting and non-orbiting scroll members; a heat-exchanger; an expansion device; and means for detecting an input voltage to said scroll compressor, for detecting a power consumption of said heat pump apparatus or said scroll compressor when the detected voltage falls in a predetermined range and for regulating the pressure in the back pressure chamber so as to decrease the power consumption.

5. A heat pump apparatus comprising: a scroll compressor including an orbiting scroll member in which a spiral wrap is formed on a first base plate, and an non-orbiting scroll member in which a spiral wrap is formed on a second base plate, and a back pressure chamber for introducing pressure into a side of the orbiting scroll member or the non-orbiting scroll member opposite to a compression chamber formed by said orbiting and non-orbiting scroll members; an outdoor heat-exchanger; an indoor heat-exchanger; an expansion device; means for regulating the pressure in the back pressure chamber; means for storing a rotational speed of said scroll compressor, a rotational speed of a fan in said outdoor heat-exchanger, a rotational speed of a fan in said indoor heat-exchanger, and an opening degree of said expansion device; and means for detecting a change in power consumption of the heat pump apparatus, wherein when it is determined that the variation in power consumption is larger than a predetermined value after said pressure regulating means changes the pressure in the back pressure chamber, the pressure control in the back pressure chamber by the pressure regulating means is returned to that before changed and the rotational speed of the scroll compressor, the rotational speed of the fan in the outdoor heat-exchanger, the rotational speed of the fan in the indoor heat-exchanger, and the opening degree of the expansion device are returned to values before the pressure in the back pressure chamber is changed by said pressure regulating means.

6. A heat pump apparatus comprising: a scroll compressor including an orbiting scroll member in which a spiral wrap is formed on a first base plate, and an non-orbiting scroll member in which a spiral wrap is formed on a second base plate, and a back pressure chamber for introducing pressure into a side of the orbiting scroll member or the non-orbiting scroll member opposite to a compression chamber formed by said orbiting and non-orbiting scroll members; a heat-exchanger; an expansion device; means for detecting an actual input power to said scroll compressor; means for obtaining a power consumption of said scroll compressor from condition quantity of said heat pump apparatus at present; and means for regulating the pressure of the back pressure chamber so as to cause the actual input power to said scroll compressor close to said power consumption.

7. A heat pump apparatus according to claim 6, wherein the present condition quantity of said heat pump apparatus includes a suction pressure of said scroll compressor, a discharge pressure of said scroll compressor, a temperature of refrigerant upstream of said expansion device, and a rotational speed of said scroll compressor.

8. A scroll compressor comprising: an orbiting scroll member in which a spiral wrap is formed on a first base plate, and an non-orbiting scroll member in which a spiral wrap is formed on a second base plate, a back pressure chamber for introducing pressure into a side of the orbiting scroll member or the non-orbiting scroll member opposite to a compression chamber formed by said orbiting and non-orbiting scroll members, a communication passage communicating the back pressure chamber with a suction pressure zone, valve means provided in the communication passage, detecting means for detecting a power consumption of said scroll compressor, and means for changing a flow passage resistance of said valve in accordance with an output from said detecting means.

9. A scroll compressor according to claim 8, wherein said valve is adapted to be opened and closed by a spring force in response to a differential pressure between said back pressure chamber and said suction pressure zone, and said means for changing the flow passage resistance changes said spring force.

10. A scroll compressor according to claim 8, wherein said valve comprises a needle valve, and said means for changing the flow passage resistance adjusts opening degree of said needle valve.

11. A scroll compressor according to claim 8, wherein said valve comprises a rotary valve, and said means for changing the flow passage resistance adjusts opening degree of said rotary valve.

12. A heat pump apparatus according to any one of claims 1 to 7, wherein said scroll compressor includes a load control device in a compression mechanism part.

* * * * *

UNITED STATES PATENT AND TRADEMARK OFFICE

CERTIFICATE OF CORRECTION

PATENT NO. : 6,301,912 B1
DATED : October 16, 2001
INVENTOR(S) : Toshiyuki Terai et al.

It is certified that error appears in the above-identified patent and that said Letters Patent is hereby corrected as shown below:

Title page,
Item [30], Foreign Application Priority Data, replace "Sep. 1, 1998 (JP) 10-264296" with -- Sep. 18, 1998 (JP) 10-264296 --.

Signed and Sealed this

Twenty-third Day of April, 2002

*Attest:*

*Attesting Officer*

JAMES E. ROGAN
*Director of the United States Patent and Trademark Office*